United States Patent [19]

Bowman et al.

[11] Patent Number: 4,865,946

[45] Date of Patent: Sep. 12, 1989

[54] TEMPORARY BARRIER LAYER FOR PHOTOGRAPHIC ELEMENT

[75] Inventors: Wayne A. Bowman, Walworth; Ronald L. Verhow, Rochester, both of N.Y.

[73] Assignee: Eastman Kodak Company, Rochester, N.Y.

[21] Appl. No.: 215,109

[22] Filed: Jul. 5, 1988

Related U.S. Application Data

[51] Int. Cl.[4] ..... G03C 5/54; G03C 1/02

[52] U.S. Cl. ..... 430/215; 430/454; 430/523; 430/536

[58] Field of Search ..... 430/215, 454, 463, 449, 430/523, 536

[56] References Cited

U.S. PATENT DOCUMENTS

| | | | |
|---|---|---|---|
| 3,362,819 | 1/1968 | Land | 430/216 |
| 3,421,686 | 1/1969 | Caplin et al. | 230/116 |
| 3,455,686 | 1/1969 | Farney et al. | 430/215 |
| 3,785,815 | 1/1974 | Avtges et al. | 430/215 |
| 4,056,394 | 11/1977 | Hamii | 430/215 |
| 4,256,827 | 3/1981 | Naguchi et al. | 430/215 |
| 4,297,431 | 10/1981 | Sullivan | 430/215 |
| 4,355,091 | 10/1982 | MacLeish et al. | 430/216 |
| 4,426,481 | 1/1984 | Sullivan | 524/460 |
| 4,458,001 | 7/1984 | Taylor | 430/215 |
| 4,504,569 | 3/1985 | Abel et al. | 430/214 |

FOREIGN PATENT DOCUMENTS 1340349 12/1970 United Kingdom .

*Primary Examiner*—Richard L. Schilling
*Attorney, Agent, or Firm*—Paul L. Marshall

[57] ABSTRACT

A polymer composition of the formula:

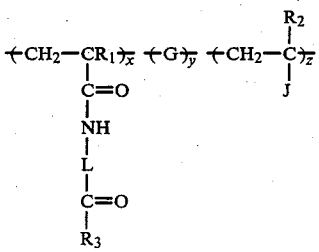

wherein $R_1$, $R_2$, $R_3$, G, J, L, x, y, and z are as defined herein is useful as a temporary barrier between reactants in photographic materials. The barrier is particularly useful as a process timing layer in color image transfer film units.

6 Claims, No Drawings

TEMPORARY BARRIER LAYER FOR PHOTOGRAPHIC ELEMENT

FIELD OF THE INVENTION

This invention relates to temporary barriers that delay the contact of one reactant with another reactant in photographic elements and more particularly to color diffusion transfer film units having such barriers as timing layers.

BACKGROUND OF THE INVENTION

Interlayers have been used in multicolor photographic elements to aid in differential processing of various silver halide emulsions after exposure and to minimize the effects of one layer of the element on another when both are simultaneously undergoing treatment as disclosed by Neblett, *Photography, Its Materials and Processes,* 1962, Chapter 33. The use of improved interlayers in a multicolor image transfer film unit is well known, as disclosed in, for example, U.S. Pat. Nos. 3,411,904 and 3,418,117, both by Becker. The interlayers in many of the known film units act as temporary barriers to isolate the reactants of the surrounded layers for a predetermined length of time.

Image transfer processes that employ a single processing solution to develop an exposed image record and produce a viewable image record are well known in the art. In many instances, after-treatments such as washing or stabilizing baths are not used in these image transfer processes, since the element is a fully self-contained film unit.

In certain instances, various barrier layers, timing layers, or spacer layers have been used in image transfer film units to delay action between the ingredients of various layers of the film unit. Barrier layers have been used between polymeric acid layers and the silver halide emulsion layers of an image transfer film unit to allow processing to continue at a high pH for a predetermined period of time before the acid layer becomes effective in neutralizing the processing composition as disclosed in U.S. Pat. No. 2,584,030, issued Jan. 29, 1952.

The use of barriers or spacer layers employed in conjunction with neutralizing layers in one commercial image transfer product is described by Friedman, *History of Color Photography,* 1968, pages 538–543. In products of this type, the alkaline composition penetrates through the barrier layer and alkali is depleted throughout the structure by the acid in the neutralizing layers. In certain instances, breakdown of the barrier layers releases the materials that serve as a shutoff mechanism, establishing the amount of silver halide development and the related amount of dye formed according to the respective exposure values.

Many of the photographic development processes utilized in image transfer film units is temperature dependent. At relatively low temperatures, the development process is slower while at relatively higher temperatures, the development process is faster. This temperature dependence of development ratecan cause adverse effects on the quality of the image formed in an image transfer film unit. At colder temperatures, the breakdown of the barrier layer (which leads to shutdown of the development reaction) may occur before the slower development process is completed. At warmer temperatures, the development process may proceed too far before the barrier layer breaks down. It is therefore desirable to have a barrier layer that becomes more alkali-permeable at higher temperatures and less permeable at lower temperatures in order to compensate for the temperature dependence of the development reaction rate.

The temperature dependence of the alkali-permeability of a polymer can be measured by its activation energy, and should correspond with the temperature dependence of the particular development chemistry so that neither overdevelopment nor underdevelopment occurs across the range of temperature conditions under which the image transfer film unit will likely be used. Activation energy in Kcal/mole is determined from the slope of the straight line potion of the curve according to the formula:

$$E_a = 0.00458 \times \frac{\log(Y^2/Y^1)}{1/T_2 - 1/T_1}$$

A discussion of activation energy calculations can be found in *Kinetics and Mechanism* 2d, John Wiley & Sons, New York, 1961, pp. 22–25.

Many layers contained in image transfer film elements utilize gelatin as a binder or vehicle. It is advantageous if temporary barrier layers used in such elements are compatible with gelatin, i.e., they can be coated from aqueous solutions. Microgel polymers are highly compatible with gelatin and gelatin coating systems. U.S. Pat. No. 4,504,569 discloses chill-gelable microgel temporary barrier layers comprising cross-linked N-alkyl-substituted acrylamide polymers. These polymers, however, have a negative activation energy, rendering them unsuitable for many applications.

It would therefore be desirable to have a polymer for use as a temporary barrier layer that has a positive activation energy that is compatible with photographic development chemistry used in image transfer film units and that is a microgel compatible with aqueous gelatin systems.

SUMMARY OF THE INVENTION

The invention provides a temporary barrier for photographic elements comprising randomly repeating units of the formula:

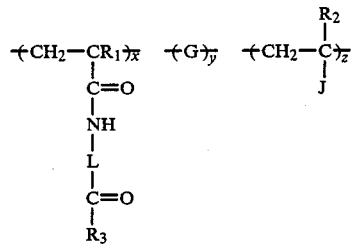

(I)

where $R_1$ and $R_2$ each independently represents hydrogen or methyl, L represents a divalent alkyl linking group of from 2 to 8 carbon atoms, $R_3$ represents alkyl of from 1 to 4 carbon atoms, J represents the residue of an organic cross-linking compound having at least one other copolymerizable carbon-carbon double bond, G represents one or more other polymerized ethylenically unsaturated comonomers, x represents 50 to 89 weight percent, y represents 1 to 40 weight percent, and z represents from 10 to 25 weight percent.

The temporary barrier layers of the invention are compatible with gelatin coatings and exhibit a desirable positive activation energy.

DESCRIPTION OF THE PREFERRED EMBODIMENTS

According to formula (I), L represents a divalent alkyl linking group of from 2 to 8 carbon atoms. This linking group may be straight (e.g., ethyl, propyl, butyl, pentyl, etc.) or it may be branched (e.g., isobutyl, isopropyl, etc.). $R_3$ is alkyl of from 1 to 4 carbon atoms (e.g., methyl, ethyl, propyl). $R_1$ and $R_2$ are each independently hydrogen or methyl.

According to formula (I), the polymer comprises from about 10 to 25 weight percent of one or more polymerized cross-linking monomers having at least two addition-polymerizable groups per molecule. These cross-linking monomers are generally well known in the art. The preferred cross-linking monomers contain iminocarbonyl or oxycarbonyl groups.

Examples of useful cross-linking monomers include:
N,N'-methylenebisacrylamide,
N,N'-methylenebismethacrylamide,
ethylene dimethacrylate,
2,2-dimethyl-1,3-propylene diacrylate,
divinylbenzene,
mono[2,3-bis(methacryloyloxy)propyl]phosphate,
N,N'-bis(methacrylolyl)urea,
triallyl cyanurate,
allyl acrylate,
allyl methacrylate,
N-allylmethacrylamide,
4,4'-isopropylidenediphenylene diacrylate,
1,3-butylene diacrylate,
1,4-cyclohexylenedimethylene dimethacrylate,
2,2'-oxydiethylene dimethacrylate,
divinyloxymethane,
ethylene diacrylate,
ethylidene diacrylate,
propylidene dimethacrylate,
1,6-diacrylamidohexane,
1,6-hexamethylene diacrylate,
1,6-hexamethylene dimethacrylate,
phenylethylene dimethacrylate,
tetramethylene dimethacrylate,
2,2,2-trichloroethylidene dimethacrylate,
ethylenebis(oxyethylene) diacrylate,
ethylenebis(oxyethylene) dimethacrylate,
ethylidyne trimethacrylate,
propylidyne triacrylate,
vinyl allyloxyacetate,
1-vinyloxy-2-allyloxyethane,
2-crotonoyloxyethyl methacrylate,
diallyl phthalate, and
2-(5-phenyl-2,4-pentadienoyloxy) ethyl methacrylate.
The preferred cross-linking monomers are ethylenebis-(iminocarbonyl, ethylenebis(oxycarbonyl), or phenylene.

The polymer can also comprise, as G, 1 to 40 weight percent of polymerized other monomers. Such monomers include ethylenically unsaturated monomers such as styrene and styrene derivatives (e.g., vinyltoluene, vinylbenzene, divinylbenzene, 4-t-butylstyrene, and 2-chloromethyl-styrene) and acrylic and methacrylic acid esters (e.g., methyl methacrylate, methyl acrylate, ethyl methacrylate, n-butyl acrylate, 2-ethylhexyl methacrylate, 2-hydroxyethyl methacrylate, 2-hydroxyethyl acrylate, ethylene dimethacrylate, methacrylamide, and acrylonitrile).

Exemplary monomers useful as G include:
acrylamide,
allyl alcohol,
N-methylolacrylamide,
N-(isobutoxymethyl)acrylamide,
N-(isobutoxymethyl)methacrylamide
glyceryl methacrylate,
2-hydroxyethyl acrylate,
2-hydroxypropyl acrylate,
N-isopropylacrylamide.
N-vinyl-caprolactam,
N-methylmethacrylamide,
methacrylamide,
maleimide,
2-hydroxyethyl methacrylate,
N-methylolmaleimide,
methacryloylurea,
N-(2-hydroxypropyl)methacrylamide,
N-vinylsuccinimide,
N-vinylphthalimide,
2-hydroxypropyl methacrylate,
N-vinyl-2-pyrrolidone,
2-acrylamido-2-hydroxymethyl-1,3-propanediol,
N,N-dimethylmethacrylamide,
N-methylacrylamide,
N-vinyl-N'-(2-hydroxyethyl)succinamide,
N-vinylcarbazole,
N-isopropylmethacrylamide,
N,N-dimethylacrylamide,
2-ethylhexyl acrylate,
n-butyl acrylate,
methyl acrylate,
methyl methacrylate,
phenyl acrylate,
2-chloroethyl methacrylate,
vinyl acetate,
ethyl acrylate,
ethyl methacrylate, and styrene.

Preferred polymers useful in the invention are those having recurring units according to formula:

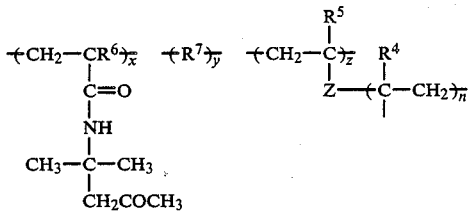

(II)

wherein Z is a linking group; $R^4$, $R^5$, and $R^6$ are individually hydrogen methyl; $R^7$ represents recurring units in the polymer of one or more polymerized addition polymerizable comonomers; n is 1 or 2; and x, y, and z are as defined above.

In formula (II), Z is a linking group between separate polymer backbone chains and can be a heteroatom linking group such as an ester, amide, urylenedicarbonyl, urethane, ether, imino, or the like linking group, or an "n+1" valent nucleus of one or a combination of aliphatic, aromatic, cyclic, and heterocyclic nuclear groups having 0 to n+1 heteroatom linking groups aformentioned, or combinations thereof. Thus, Z has one covalent bond to each ($CH_2$—CR) group present. Preferred nuclei include alkylenebis(iminocarboyl)

such as methylenebis(iminocarbonyl); alkylenebis(oxycarbonyl) such as ethylenebis(oxycarbonyl), ureylenedicarbonyl; or arylene such as phenylene.

$R^1$ represents recurring units of 1 or more other polymerized addition polymerizable compounds such as previously described.

Preferred polymers useful as barrier layers include poly[N-(1,1-dimethyl-3-oxobutyl) acrylamide-co-acrylamide-co-n-butyl acrylate-co-N,N'-methylenebisacrylamide], poly[N-(1,1-dimethyl-3-oxobutyl) acrylamide-co-N,N-dimethyl acrylamide-co-N,N'-methylenebisacrylamide], and poly[N-(1,1-dimethyl-3-oxobutyl) acrylamide-co-n-butyl acrylate-co-N,N'-methylenebisacrylamide].

The above polymers generally have molecular weights of from 100,000 to 1,000,000 and preferably from about 100,000 to 500,000 based on the light-scattering method. The particle size of the polymers is preferably about 0.1 to 0.5μ.

The above polymers are formed by randomly polymerizing the monomers together. The polymerization can be carried out using catalysts such as potassium persulfate and 4,4'-azobis-(4-cyanovaleric acid) and heating for a period of 60 minutes to 180 minutes at 60° C. to 80° C. The resulting polymer is hydrophilic and the cross-linking should be done during polymerization, rather than after polymerization to form a latex, i.e. dispersion rather than solution polymer.

The above polymers are prepared in the form of microgel dispersions by simply polymerizing the selected monomers in aqueous dispersions by conventional emulsion polymerization techniques at elevated temperature, e.g., above about 60° C., preferably at about 70° C. to 80° C. to form a polymer latex, and cooling to ambient temperature. The resulting microgel dispersion preferably contain about 10 to about 20 percent solids.

The microgel dispersions can be coated as barrier layers by conventional aqueous coating procedures, such as curtain coating, roll coating, and other well-known procedures. The preferred coverage for these coated barrier layers ranges from about 0.5 to about 30 $g/m^2$, and preferably from about 3 to about 11 $g/m^2$.

A photographic element according to this invention can comprise a support, preferably at least one silver halide layer, two or more reactants and a temporary barrier layer separating at least one reactant of the photographic element from at least one other reactant, said barrier layer comprising the above-described polymer.

The barrier layers are coated as a microgel dispersion layer in a photographic element. The microgel dispersions are generally coated on a suitable coated or non-coated photographic support such as poly(ethylene terephthalate), glass, or metal, and then drying by means such as air drying. The element can be overcoated with a layer or series of layers either before or after drying.

Various reactants which can be separated by this technique include acids and bases, developing agents and development restrainers, bleaching agents and metallic silver, silver halide and silver halide solvents and the like.

A photographic film unit according to this invention can comprise (a) a support having thereon at least one photosensitive silver halide emulsion layer preferably having, associated therewith a dye image-providing material; (b) an image-receiving layer; (c) alkaline processing composition and means for dischargeing same within the assemblage; (d) a neutralizing layer for neutralizing said alkaline processing composition; and (e) a barrier layer positioned between the neutralizing layer and said photosensitive silver halide emulsion layer and dye image-providing material, the film unit containing a silver halide developing agent, and wherein said barrier layer comprises the above-described polymer.

A photographic film unit can be manufactured by coating onto a support a neutralizing layer and then a barrier layer of the present invention. A second support is then coated with an image-receiving layer, a light-reflecting layer, and then photosensitive layers having associated therewith dye image-providing materials. The two supports are juxtaposed so that coated sides are contiguous. A rupturable container filled with processing composition is then placed adjacent to the juxtaposed supports in such a manner that a compressive force can be used to discharge the processing composition between the two supports.

In one embodiment according to this invention, the film units are integral negative-receiver color diffusion transfer film units in which the barrier layer of the invention can be employed on a cover sheet as disclosed in Canadian Pat. No. 928,559. In this embodiment, the support for the photosensitive element is transparent and is coated with the image-receiving layer, an opaque light-reflective layer, a black opaque layer and photosensitive layers having associated therewith dye image-providing materials. A rupturable container containing an alkaline processing composition and an opacifier, such as carbon black, is positioned adjacent the top layer and a transparent cover sheet. The cover sheet comprises a transparent support which is coated with a neutralizing layer and the barrier layer of this invention. For further details concerning the format of this particular integral film unit, reference is made to the above-mentioned Canadian Pat. No. 928,559, which is incorporated herein by reference.

Another embodiment of a film unit of an integral color diffusion transfer film unit in which the barrier layer of the invention can be employed in a dye image-receiving element is described in U.S. Pat. No. 3,415,644. This photosensitive element comprises an opaque support which is coated with photosensitive layers having associated therewith dye image-providing material. A rupturable container containing an alkaline processing composition, $TiO_2$ to provide a white viewing background after processing and an indicator dye (see U.S. Pat. No. 3,647,437) is positioned adjacent the top layer and a transparent receiver. The receiver comprises a transparent support which is coated with a neutralizing layer, a barrier layer and an image-receiving layer. For further details concerning the format of this particular film unit, reference is made of the above-mentioend U.S. Pat. No. 3,415,644, which is incorporated herein by reference.

Another embodiment of a color diffusion transfer system in which the barrier system of the invention can be employed in a dye image-receiving element is described in U.S. Pat. No. 3,362,819. The image-receiving element comprises a support, which is usually opaque, having thereon a neutralizing layer, the barrier layer of this invention and a dye image-receiving layer. For further details concerning the use of such an element in color transfer film units, reference is made to the above-mentioned U.S. Pat. No. 3,362,819, which is incorporated herein by reference.

Still other useful integral formats in which this invention can be employed are described in U.S. Pat. Nos. 3,415,634; 3,415,646; 3,647,437; 3,635,707; and 3,594,165, and British Pat. No. 1,330,524.

The photosensitive element useful in this invention can be treated with an alkaline processing composition to effect or initiate development in any manner. A preferred method for applying processing composition is by use of a rupturable container or pod which contains the composition. In general, the processing composition employed in this invention contains the developing agent for development, although the composition could also be just an alkaline solution where the developer is incorporated in the photosensitive element. In such case, the alkaline solution serves to activate the incorporated developer.

The dye image-providing materials which may be employed in this invention generally may be characterized as either (1) initially soluble or diffusible in the processing composition but selectively rendered non-diffusible in an imagewise pattern as a function of development, such as those disclosed, for example, in U.S. Pat. Nos. 2,647,049; 2,661,293; 2,698,244; 2,698,798; 2,802,735; 2,774,557 and 2,983,606, or (2) initially insoluble or non-diffusible in the processing composition but providing a diffusible image dye-providing material as a function of development, such as those disclosed, for example, in U.S. Pat. Nos. 3,227,550, 3,227,551, 3,227,552, 3,227,554, 3,243,294 and 3,445,228. These materials may contain preformed dyes or dye precursors, e.g. color couplers, oxichromic compounds and the like.

In a preferred embodiment of the invention, the dye image-providing material is a ballasted redox dye-releaser. Such compounds are, generally speaking, compounds which can be oxidized, i.e., cross-oxidized, by an oxidized developing agent to provide a species which as a function of oxidation will release a diffusible dye, such as by alkaline hydrolysis. Such redox dye releasers are described in U.S. Pat. Nos. 3,725,062; 3,698,897; 3,628,952; 3,443,939; 3,443,940; 4,076,529; 3,928,312; 3,942,987; 3,932,381; 3,931,144; 4,053,312; 4,055,428; 3,728,113; German Pat. Nos. 2,505,248 and 2,729,820 and *Research Disclosure* Nos. 15157 (November, 1976) and 15654 (April, 1977). Positive working systems include U.S. Pat. Nos. 3,980,479 and 4,139,379 and U.K. Pat. No. 1,464,104.

The term "non-diffusible" as used throughout the specification is intended to mean that the material will not substantially diffuse either within or from the layer in which it is located within the photographic element during contact in an alkaline solution at a pH, for example, of greater than 11. In most cases, the material is ballasted so as to render it non-diffusible. Likewise, the term "diffusible" is intended to mean that the material when in contact with alkaline solution under conditions similar to those described above will substantially migrate from its layer in the photographic element to the image-receiving layer where it is mordanted.

In one preferred embodiment of this invention, the redox dye releasers in U.S. Pat. No. 4,076,529, referred to above are employed. Such compounds are non-diffusible sulfonamido compounds which are alkali-cleavable upon oxidation to release a diffusible sulfonamido dye. The polymer barrier layers of formula (I), which have an activation energy of from 0 to 5 kcal/mole, provide advantageously alkaline permeability as a function of temperature that is compatible with this image-forming chemistry. For further details concerning the above-described sulfonamido compounds as specific examples of same, reference is made to the above-mentioned U.S. Pat. No. 4,076,529 and Belgian Pat. No. 799,268 issued Feb. 28, 1973, the disclosures of which are hereby incorporated by reference.

In another preferred embodiment of this invention, initially diffusible dye image-providing materials are employed such as dye developers, including metal-complexed dye developers such as those described in U.S. Pat. Nos. 3,482,972, 3,453,207, 3,554,545, 3,552,406, 3,563,739, 3,597,200 and 3,705,184, and oxichromic developers as described and claimed in U.S. Pat. No. 3,880,658, the disclosures of which are hereby incorporated by reference. When oxichromic developers are employed, the image is formed by the diffusion of the oxichromic developer to the dye image-receiving layer where it undergoes chromogenic oxidation to form an image dye.

The film unit of the present invention may be used to produce positive images in single- or multi-colors, as well as in black-and-white. In a three-color system, each silver halide emulsion layer of the film assembly will have associated therewith a dye image-providing material capable of providing a dye having a predominant spectral absorption within the region of the visible spectrum to which said silver halide emulsion is sensitive, i.e. the blue-sensitive silver halide emulsion layer will have a yellow dye image providing material associated therewith, the green-sensitive silver halide emulsion layer will have a magenta dye image-providing material associated therewith, and the red-sensitive silver halide emulsion layer will have a cyan dye image-providing material associated therewith. The dye image-providing material associated with each silver halide emsulion layer may be contained either in the silver halide emulsion layer itself or in a layer contiguous to the silver halide emulsion layer.

The concentration of the dye image-providing materials that are employed in the present invention may be varied over a wide range depending upon the particular compound employed and the results which are desired. For example, the dye image-providing compounds may be coated as dispersions in layers by using coating compositions containing a weight ratio between about 0.25 and about 4 of the dye image-providing compound to the hydrophilic film-forming natural material or synthetic polymer binder, such as gelatin, polyvinyl alcohol, etc., which is adapted to be permeated by aqueous alkaline processing composition.

Generally, most silver halide developing agents can be employed to develop the silver halide emulsions in the photographic elements of this invention. The developer may be employed in the photosensitive element to be activated by the alkaline processing composition. Specific examples of developers which can be employed in this invention are given in *Research Disclosure,* 151, No. 15162, November, 1976.

In using redox dye releaser compounds in this invention, diffusible dye images are produced as a function of development of the silver halide emulsions. If the silver halide emulsion employed forms a direct-positive silver image, a positive image can be obtained on the dye image-receiving layer when redox releasers are employed which release dye where oxidized. After exposure of the film unit, the alkaline processing composition permeates the various layers to initiate development in the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the redox dye releaser compound, the oxidized form of which either releases directly or undergoes a base-catalyzed reaction to release the preformed dyes or the dye precursors imagewise as a function of the imagewise exposure of each of the silver halide emulsion layer. At least a portion of the imagewise distribution of diffusible dyes or dye precursors diffuses to the image-receiving layer to form a positive image of the original subject.

Internal-iamge silver halide emulsions useful in the above-described embodiment are direct-positive emulsions that form latent images predominantly inside the silver halide grains, as distinguished from silver halide grains that form latent images predominently on the surface thereof. Such internal-image emulsions were described by Davey et al in U.S. Pat. No. 2,592,250 issued Apr. 8, 1952, and elsewhere in the literature. Other useful emulsions are described in U.S. Pat. Nos. 3,761,276, 3,761,266 and 3,761,267, all issued Sept. 25, 1973.

The internal-image silver halide emulsions when processed in the presence of fogging or nucleating agents provide direct-positive silver images. Such emulsions are particularly useful in the above-described embodiment. Suitable fogging agents include the hydrazines disclosed by Ives, U.S. Pat. Nos. 2,588,982 issued Mar. 11, 1952 and 2,563,785 issued Aug. 7, 1951; the hydrazides and hydrazones disclosed by Whitmore, U.S. Pat. No. 3,227,552 issued Jan. 4, 1966; hydrazone quaternary salts described in British Pat. No. 1,283,835 and U.S. Pat. No. 3,615,615; hydrazone-containing polymethine dyes described in U.S. Pat. No. 3,718,470; and the fogging agents disclosed in U.S. Pat. Nos. 4,030,925 and 4,031,172 both of Leone et al or mixtures thereof. The quantity of fogging agent employed can be widely varied depending upon the results desired.

Typical useful direct-positive emulsions are disclosed in U.S. Pat. Nos. 3,227,552 by Whitemore issued Jan. 4, 1966, 3,761,276 by Evans issued Sept. 25, 1973, 3,923,513 by Evans issued Dec. 2, 1975, 3,761,267 by Gilman et al, 3,761,266 by Milton, 3,703,584 by Motter, and the like.

In other embodiments, the direct-positive emulsions can be emulsions which have been fogged either chemically or by radiation on the surface of the silver halide grains to provide for development to maximum density without exposure. Upon exposure, the exposed areas do not develop, thus providing for image discrimination and a positive image. Silver halide emulsions of this type are very well-known in the art and are disclosed, for example, in U.S. Pat. Nos. 3,367,778 by Berriman issued Feb. 6, 1968, and 3,501,305, 3501,306 and 3,501,307 by Illingsworth, all issued Mar. 17, 1970.

In still other embodiments, the direct-positive emulsions can be of the type described by Mees and James, "The Theory of the Photographic Process," published by MacMillan Company, New York, N.Y., 1966, pp. 149–167.

The various silver halide emulsion layers of a color film assembly of the invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layer for absorbing or filtering blue radiation that may be transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in this invention can be of the type disclosed in U.S. Pat. Nos. 2,543,181, 2,643,886, 2,653,732, 2,734,051, 3,056,492, 3,056,491 and 3,152,515. In general, such containers comprise a reactangular sheet of fluid- and air-impervious material folded longitudinally upon itself to form two walls which are sealed to one another along their longitudinal and end margins to form a cavity in which processing solution is contained.

In a color photographic film unit according to this invention, each silver halide emulsion layer containing a dye image-providing material or having the dye image-providing material present in a contiguous layer may be separated from the other silver halide emulsion layers in the negative portion of the film unit by materials including gelatin, calcium alginate, or any of those disclosed in U.S. Pat. No. 3,384,483, polymeric materials such as polyvinylamides as disclosed in U.S. Pat. No. 3,421,892, or any of those disclosed in French Pat. No. 2,028,236 or U.S. Pat. Nos. 2,992,104, 3,043,692, 3,044,873, 3,061,428, 3,069,263, 3,069,264, 3,121,011 and 3,427,158.

Generally speaking, except where noted otherwise, the silver halide emulsion layers in the invention comprise photosensitive silver halide dispersed in gelatin and are about 0.25 to 5 microns in thickness; the dye image-providing materials are dispersed in an aqueous alkaline solution-permeable polymeric binder, such as gelatin, as a separate layer about 0.25 to 5 microns in thickness; and the alkaline solution-permeable polymeric interlayers, e.g., gelatin, are about 0.25 to 5 microns in thickness. Of course, these thicknesses are approximate only and can be modified according to the product desired.

The alkaline solution-permeable, light-reflective reflective layer employed in certain embodiments of photographic film units of this invention can generally comprise any opacifier dispersed in a binder as long as it has the desired properties. Particularly desirable are white light-reflective layers. Suitable opacifying agents include titanium dioxide, barium sulfate, zinc oxide, barium stearate, silver flake, silicates, alumina, zirconium oxide, zirconium acetyl acetate, sodium zirconium sulfate, kaolin, mica, or mixtures thereof in widely varying amounts depending upon the degree of opacity desired. Brightening agents such as the stilbenes, coumarines, triazines and oxazoles can also be added to the light-reflective layer, if desired. When it is desired to increase the opacifying capacity of the light-reflective layers, dark-colored opacifying agents, e.g., pH-indicator dyes may be added to it, or carbon black, nigrosine dyes, etc., may be coated in a separate layer adjacent the light-reflective layer.

The neutralizing layer employed in this invention, which becomes operative after permeation of the processing composition through the barrier layer or layers, will effect a reduction in the pH of the image layers from about 13 or 14 to at least 11 and preferably 5 to 8 within a short time after imbibition. For example, polymeric acids as disclosed in U.S. Pat. No. 3,362,819 or solid acids or metallic salts, e.g. zinc acetate, zinc sulfate, magnesium acetate, etc., and disclosed in U.S. Pat. No. 2,584,030 may be employed with good results. Such neutralizing or pH-lowering materials reduce the pH of the film unit after development to terminate development and substantially reduce further dye transfer and thus stabilize the dye image.

Any material can be employed as the image receiving layer in this invention as long as the desired function of mordanting or otherwise fixing the dye images will be obtained. The particular material chosen will, of course, depend upon the dye to be mordanted. If acid dyes are to be mordanted, the image-receiving layer can contain basic polymer mordants such as polymers of amino guanidine derivatives of vinyl methyl ketone such as described by Minsk, U.S. Pat. No. 2,882,156 issued Apr. 14, 1959, and basic polymeric mordants such as described in U.S. Pat. Nos. 3,709,690, 3,625,694, 3,898,088 by Cohen et al issued Aug. 5, 1975, and 3,859,096 by Burness et al issued Jan. 7, 1975. Other mordants useful in this invention include poly(4-vinylpyridine), poly(1-methyl-2-vinylpyridinium p-toluenesulfonate) and similar compounds described by Sprague et al, U.S. Pat. No. 2,484,430 issued Oct. 11, 1949, and cetyl trimethylammonium bromide, etc. Effective mordanting compositions are also described in U.S. Pat. Nos. 3,271,148 by Whitmore and 3,171,147 by Bush, both issued Sept. 6, 1966, and in 3,958,995 issued May 25, 1976. Other materials useful in the dye image-receiving layer include alkaline solution-permeable polymers such as N-methoxymethyl poly(hexamethylene adipamide), partially hydrolyzed poly(vinyl acetate) and other materials of a similar nature.

The alkaline processing composition employed in this invention is the conventional aqueous solution of an alkaline material, e.g. sodium hydroxide, sodium carbonate or an amine such as diethylamine, preferably possessing a pH in excess of 11, and preferably containing a developing agent as described previously. The solution also preferably contain a viscosity-increasing compound such as a high-molecular-weight polymer, e.g., a water-soluble ether inert to alkaline solution such as hydroxyethyl cellulose or alkali metal salts of carboxymethyl cellulose such as sodium carboxymethyl cellulose. In certain embodiments of this invention, an opacifying agent, e.g. $TiO_2$, carbon black, indicator dyes, etc., may be added to the processing composition.

The support for the photographic elements of this invention can be any material as long as it does not deleteriously effect the photographic properties of the film unit and is dimensionally stable. Typical flexible sheet materials include cellulose nitrate film, cellulose acetate film, poly(vinyl acetal) film, polystyrene film, poly(ethyleneterephthalate) film, polycarbonate film, poly-α-olefins such as polyethylene and polypropylene film, and related films or resinous materials.

The silver halide emulsions useful in this invention are well-known to those skilled in the art and are described in "Product Licensing Index," Volume 92, December, 1971, publication 9232, p. 107, paragraph I, "Emulsion types." They may be chemically and spectrally sensitized as described on p. 107, paragraph III, "Chemical sensitization," of the above article; they can be protected against the production of fog and can be stabilized against loss of sensitivity during keeping by employing the materials described on p. 107, paragraph V, "Antifoggants and Stabilizers," of the above article; they can contain development modifiers, hardeners, and coating aids as described on pp. 107–108, paragraph IV, "Development modifiers"; paragraph VII, "Hardeners"; and paragraph XII, "Coating aids," of the above article; they and other layers in the photographic elements used in this invention can contain plasticizers, vehicles and filter dyes described on p. 108, paragraph XI, "Plasticizers and lubricant," and paragraph VIII, "Vehicles," and p. 109, paragraph XVI, "Absorbing and filter dyes," of the above article; they and other layers in the photographic elements used in this invention may contain addenda which are incorporated by using the procedures described on p. 109, paragraph XVII, "Methods of addition," of the above article; and they can be coated using the various techniques described on p. 109, paragraph XVIII, "Coating procedures," of the above article; the disclosures of which are hereby incorporated by reference.

The barrier layers of the invention can contain addenda such as developer inhibitor precursors or competing developer precursors, which are released only as the layer breaks down. Use of such compounds in barrier layers are described in U.S. Pat. No. 4,009,029.

The following preparations and examples further illustrate the invention:

PREPARATION 1

Poly[N-(1,1-dimethyl-3-oxobutyl) acrylamide-co-acrylamide-co-n-butyl acrylate-co-N,N'-methylenebisacrylamide]

A suspension of 1200 ml distilled water, 360 g 1,1-dimethyl-3-oxobutyl acrylamide, 60 g acrylamide, 60 g ethylene glycol dimethylacrylate, 120 g butyl acrylate, and 90 ml of a 30 percent solution of Sipex® SB surfactant was degassed with nitrogen and added over a period of 50 minutes to a solution of 6.0 g potassium persulfate, 1.20 g sodium metabisulfite, and 90 ml of a 30 percent solution of Sipex® SB surfactant in 1200 ml distilled water at 80° C. The resulting latex was stirred at 80° C. under nitrogen for one hour, cooled, and dialized against distilled water for 16 hours to yield a white suspension containing 11 percent solids of the polymer.

EXAMPLE 1

Preparation of cover sheets containing barrier layers of the present invention

A number of processing cover sheets were prepared by coating on a polyester film support a first layer of a copolymer, poly(n-butyl acrylate-co-acrylic acid) (30:70 weight ratio) of 1.4 $g/m_2$ which is equal to 140 meq $acid/m_2$ and secondly, a barrier layer of various microgel copolymers of the present invention as shown in Tables I–III below. The microgel polymer aqueous coating solutions contained about 15 percent solids. The sheets were then each air dried. Wet coverages were varied to accommodate the required dry coverage, which was up to 6.5 g/m2 of solids.

The effectiveness of the barrier layer in the cover sheet was measured by determining the "barrier layer breakdown," i.e., the time required to reduce the pH of a simulated laminated film unit to about pH 10 as measured by the color change of the indicator dye thymolphthalein from blue to colorless. The dye was contained in an element which consisted of a gelatin layer containing the thymolphthalein dye coated on a polyester film support. An alkaline solution containing 47 grams per liter of potassium hydroxide was employed in a pod and spread between the element containing the indicator dye and the cover sheet by passing the "sandwich" between a pair of juxtaposed pressure rollers in a manner of processing an integral-imaging-receiver, color image transfer element so that the developer layer thickness was 75 μm.

The "barrier layer breakdown" (Y) reported at each temperature is the average for five samples. The timing for each sample is time interval between lamination and the mean of the time when the indicator dye begins to decolorize and the time when the dye has completely changed color as determined by visual observation. Measurements were made over the range 13° to 60° C. An Arrhenius plot of log Y, representing time (sec), against reciprocal temperature, 1/T(°K.), approximated a straight line. The activation energy of the penetration of alkali through the layer (and its subsequent neutralization), $E_a$, the slope of this plot, was calculated from the formula:

$$E_a = 0.00458 \times \frac{\log(Y^2/Y^1)}{1/T_2 - 1/T_1}$$

$Y^2$ and $Y^1$ representing two values of barrier layer breakdown obtained at two representative temperatures on the line.

Tables I–III shows barrier layer breakdowns in seconds for each barrier layer at various coverages. The activation energy ($E_a$) of each barrier layer is also shown. The A component of each barrier layer polymer is N-(1,1-dimethyl-3-oxobutyl)-acrylamide. The B and C components of each barrier layer polymer and the weight ratios represented by x, y, and z vary between polymers as indicated the following polymer key.

Polymer Key

The cross-linking components ($C_y$) were:
C1—N,N'-Methylenebisacrylamide
C2—Ethyleneglycol dimethacrylate
C3—Ethyleneglycol diacrylate
C4—Diethyleneglycol diacrylate
The other component was varied:
B1—Acrylamide
B2—n-Butyl acrylate
B3—N,N-Dimethylacrylamide
B4—Acrylic acid
B5—Methacrylic acid

TABLE I

| | $A_xB_zC_y$ | | | | | |
|---|---|---|---|---|---|---|
| Polymer | B | C | Weight Ratio x/z/y | Coverage (g/m²) | TLB (sec) | Ea. approx. (kcal/mole) |
| 1 | B1 | C1 | 70/20/10 | 2.7 | 20 | nd |
| | B1 | C1 | 70/20/10 | 5.4 | 35 | nd |
| 2 | B1 | C2 | 60/30/10 | 5.4 | 25 | +4 |
| 3 | B1 | C2 | 70/20/10 | 2.7 | 20 | +4 |
| | B1 | C2 | 70/20/10 | 5.4 | 45 | +4 |
| | B1 | C2 | 80/10/10 | 3.2 | 80 | +3 |
| 4 | B2 | C1 | 60/30/10 | 1.1 | 140 | * |
| | B2 | C1 | 60/30/10 | 3.2 | 1200 | * |
| 5 | B2 | C1 | 70/20/10 | 3.2 | 1370 | * |
| 6 | B3 | C1 | 60/30/10 | 2.7 | <20 | nd |
| | B3 | C1 | 60/30/10 | 5.4 | 35 | nd |
| 7 | B3 | C2 | 60/30/10 | 2.7 | 30 | 0 |
| | B3 | C2 | 60/30/10 | 5.4 | 65 | 0 |

nd — not determined
* — slightly negative

TABLE II

| | $A_xB_{z1}B_{z2}C_y$ | | | Cover- | | |
|---|---|---|---|---|---|---|
| Poly-mer | B | C | Weight Ratio x/z1/z2/y | age (g/m²) | TLB (sec) | Ea. approx. (kcal/mole) |
| 8 | B1B2 | C1 | 50/10/30/10 | 3.2 | 35 | +1 |
| | B1B2 | C1 | 50/10/30/10 | 5.4 | 90 | +1 |
| 9 | B1B2 | C1 | 60/10/20/10 | 3.2 | 55 | 0 |
| | B1B2 | C1 | 60/10/20/10 | 5.4 | 95 | 0 |
| 10 | B1B2 | C1 | 50/30/10/10 | 3.2 | <20 | +3 |
| | B1B2 | C1 | 50/30/10/10 | 5.4 | <20 | +3 |
| 11 | B1B2 | C1 | 60/20/10/10 | 6.5 | <20 | nd |

nd — not determined
* — slightly negative

TABLE III

| | $A_xB_{z1}B_{z2}C_y$ | | | Cover- | | |
|---|---|---|---|---|---|---|
| Polymer | B | C | Weight Ratio x/z1/z2/y | age (g/m²) | TLB (sec) | Ea. approx. (kcal/mole) |
| 12 | B1B1 | C2 | 60/10/20/10 | 3.2 | 70 | +5 |
| | B1B2 | C2 | 60/10/20/10 | 5.4 | 130 | +5 |
| 13 | B1B2 | C2 | 50/10/30/0 | 3.2 | 55 | +1 |
| | B1B2 | C2 | 50/10/30/0 | 5.4 | 75 | +1 |
| 14 | B1B2 | C2 | 60/20/10/10 | 3.2 | <20 | nd |
| 15 | B1B2 | C2 | 50/30/10/10 | 6.5 | <20 | nd |
| 16 | B1B2 | C3 | 60/10/20/10 | 3.2 | 55 | +5 |
| | B1B2 | C3 | 60/10/20/10 | 6.5 | 85 | +5 |
| 17 | B1B2 | C3 | 60/20/10/10 | 6.5 | <20 | nd |
| 18 | B1B2 | C4 | 60/10/20/10 | 3.2 | 55 | +5 |
| | B1B2 | C4 | 60/10/20/10 | 6.5 | 100 | +5 |
| 19 | B1B2 | C4 | 50/10/30/10 | 3.2 | 45 | +3 |
| | B1B2 | C4 | 50/10/30/10 | 6.5 | 75 | +3 |
| 20 | B2B4 | C1 | 60/25/5/10 | 5.4 | <20 | nd |
| 21 | B2B5 | C1 | 60/25/5/10 | 5.4 | 30 | nd |

nd — not determined
* — slightly negative

EXAMPLE 2

The improved process temperature sensitivity obtainable with these timing layers compared to earlier microgel timing layers of negative activation energy is shown in an image transfer formulation using sulfonamidonaphthol redox dye releasers (RDR).

A cover sheet of the invention having the following composition was prepared:

| | |
|---|---|
| Timing layer: | Poly(diacetoneacrylamide-co-acrylamide-co-n-butyl acrylate-co-ethyleneglycol methacrylate) (60:10:20:10 weight ratio (4.3 g/m²) |
| Acid layer: | Poly(n-butyl acrylate-co-acrylic acid) (30:70 weight ratio) (equivalent to 140 meq acid/m²) |

Coated on clear polyester support

This timing layer had a timing layer breakdown (TLB) of 77 sec. at 24° C. A control cover sheet was prepared that had as a timing layer: poly(N-isopropylacrylamide-co-ethyl methacrylate-co-N,N'-methylenebisacrylamide) (70:20:10 weight ratio) (3.2 g/m²) coated over the same acid layer as the experiment cover sheet. This control timing layer had a TLB of 87 sec. at 24° C.

An integral imaging receiver, IIR, of the following structure was prepared. Coverages are in (g/m²).

| | |
|---|---|
| Overcoat layer: | yellow RDR (0.16), 2,5-didodecylhydroquinone (0.32), gelatin (0.88) |
| Blue-sensitive silver chloride layer: | (0.80 Ag), gelatin (0.82) |
| Yellow RDR layer: | yellow RDR (0.80), gelatin (1.2) |

-continued

| | |
|---|---|
| Interlayer: | 2,5-didodecylhydroquinone (0.75), gelatin (1.2) |
| Green-sensitive silver chloride layer: | (0.66 Ag), gelatin (0.90) |
| Magenta RDR layer: | magenta RDR (0.48), gelatin (1.0) |
| Interlayer: | 2,5-didodecylhydroquinone (0.59), electron transfer agent, ETA (0.48), gelatin (1.2) |
| Red-sensitive silver chloride layer: | (0.34 Ag), gelatin (0.62) |
| Cyan RDR layer: | cyan RDR (0.47), gelatin (0.75) |
| Opaque layer: | Carbon (1.4), 2,5-didodecylhydroquinone (0.32), gelatin (1.1) |
| Stripping layer: | Natrosol ® 250GR (0.54), Fluororad ® FC-431 (0.03) |
| Gelatin interlayer: | (0.54) |
| Receiver layer: | Poly(styrene-co-1-vinylimidazole-co-1-vinylimidazole-co-1-vinylimidazole) quaternized as the 2-hydroxyethyl chloride salt (50:40:10 mole ratio) (2.3), gelatin (2.3) |

Coated on reflective paper support

Bis(vinyl sulfonyl)methane was added to layer 11 as a hardener at 0.6 percent of the total gelatin weight. All emulsions were essentially monodispersed spherical silver chloride and contain appropriate antifoggants and sensitizing dyes. 2-Octadecyl-5-sulfohydroquinone was added to layers 12, 11, 8, and 5 to control D-min. The structures of the yellow, magenta, and cyan RDR's, and the ETA are as shown in Example 3 of U.S. Pat. No. 4,463,080.

Viscous pod processing compositions were prepared:

| | |
|---|---|
| Potassium hydroxide | 35. g/l |
| Potassium bromide | 2. g/l |
| 5-Methylbenzotriazole | 3. g/l |
| 11-Aminoundecanoic acid | 2. g/l |
| 4-Hydroxymethyl-4-methyl-1 phenyl-3-pyrazolidinone | 4. g/l |
| Carbon | 67. g/l |
| Carboxymethylcellulose | 42 g/l |

The above elements were used as follows:

A multicolor photosensitive image transfer integral imaging receiver (IIR) was exposed in a sensitometer through a step-tablet to yield a neutral at a Status A mid-scale density of approximately 1.0, then processed using a viscous processing composition contained in a pod. The processing composition was spread between the IIR and the cover sheet using a pair of juxtaposed rollers to provide a gap of 100 μm. Processing was done at three controlled temperatures of 18.3° C. (65° F.), 23.9° C. (75° F.), and 29.4° C. (85° F.). The receiver was peeled from the light-sensitive layers of the IIR at 5 min. (65° F.), 3 min. (75° F.), and 2 min. (85° F.), and the Status A reflection density was read to obtain computer generated sensitometric curves. D-min, D-max, and contrast at D=1.0 were read from these curves. The results are presented below in Table IV.

TABLE IV

| Process Temp. | | Status A Density D-max/D-min | Δ | Contrast D = 1.0 | Δ |
|---|---|---|---|---|---|
| Control | | | | | |
| 18.3° C. | R | 2.3/0.11 | −0.2/−.03 | 2.9 | +0.2 |
| 23.9° C. | R | 2.5/0.14 | — | 2.7 | — |
| 29.4° C. | R | 2.5/0.20 | 0/+.06 | 2.5 | −0.2 |
| 18.3° C. | G | 1.8/0.10 | −0.8/−.02 | 2.3 | −0.5 |

TABLE IV-continued

| Process Temp. | | Status A Density D-max/D-min | Δ | Contrast D = 1.0 | Δ |
|---|---|---|---|---|---|
| 23.9° C. | G | 2.6/0.12 | — | 2.8 | — |
| 29.4° C. | G | 2.7/0.16 | +0.1/+.04 | 2.7 | −0.1 |
| 18.3° C. | B | 1.8/0.10 | −1.1/−.02 | 2.1 | −0.9 |
| 23.9° C. | B | 2.9/0.12 | — | 3.0 | — |
| 29.4° C. | B | 3.0/0.15 | +0.1/+.03 | 3.2 | +0.2 |
| Invention | | | | | |
| 18.3° C. | R | 2.2/0.12 | −0.2/−.04 | 2.7 | −0.1 |
| 23.9° C. | R | 2.4/0.16 | — | 2.8 | — |
| 29.4° C. | R | 2.5/0.18 | +0.1/−.03 | 2.7 | −0.1 |
| 18.3° C. | G | 2.0/0.11 | −0.5/−.01 | 2.3 | −0.3 |
| 23.9° C. | G | 2.5/0.12 | — | 2.6 | — |
| 29.4° C. | G | 2.6/0.15 | +0.1/+.03 | 2.7 | +0.1 |
| 18.3° C. | B | 2.1/0.11 | −0.5/−.01 | 2.5 | −0.3 |
| 23.9° C. | B | 2.6/0.12 | — | 2.8 | — |
| 29.4° C. | B | 2.8/0.15 | +0.2/0 | 2.9 | +0.1 |

R = red
G = green
B = blue

Δ values are the difference in D-max, D-min, or contrast from the mid-processing temperature of 23.9° C.

The data in Table IV show that lesser variations in D-max, D-min, and contrast with process temperature changes are obtained with the timing layer of the invention. The greatest improvement is seen in the blue layer.

The invention has been described in detail with particular reference to preferred embodiments thereof, but it will be understood that variations and modifications can be effected within the spirit and scope of the invention.

What is claimed is:

1. A photographic element comprising a support having thereon at least one silver halide emulsion layer, a neutralizing layer, and a temporary barrier layer separating the silver halide emulsion layer from the neutralizing layer, said barrier layer including a polymer comprising randomly repeating units of the formula:

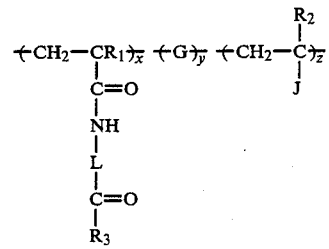

wherein $R_1$ and $R_2$ each independently represents hydrogen or methyl, $R_3$ represents alkyl of from 1 to 4 carbon atoms, L represents a divalent alkyl linking group of from 2 to 8 carbon atoms, J represents the residue of an organic cross-linking compound having at least one other copolymerizable carbon-carbon double bond, G represents recurring units derived from one or more other polymerized ethylenically unsaturated comonomers, x represents 50 to 80 weight percent, y represents 1 to 40 weight percent, and z represents from 10 to 25 weight percent.

2. A photographic element according to claim 1 wherein the polymer comprises randomly recurring units of the formula:

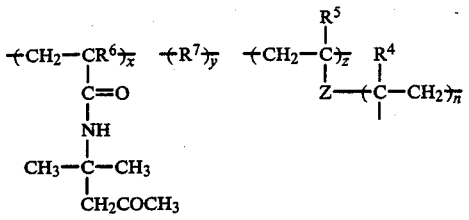

wherein

Z is a linking group, $R^4$, $R^5$, and $R^6$ are individually hydrogen or methyl, $R^7$ represents recurring units in the polymer of one or more other polymerized addition polymerizable comonomers, n is 1 or 2, x represents 50 to 89 weight percent, y represents 1 to 40 weight percent, and z represents from 10 to 25 weight percent.

3. A photographic element according to claim 1 wherein J is selected from the group consisting of ethylenebis(iminocarbonyl), ethylenebis(oxycarbonyl), and phenylene.

4. In a photographic element comprising at least open silver halide emulsion layer, a dye image-providing layer, a dye image-receiving layer, and a neutralizing layer, said element containing a temporary barrier layer located between the neutralizing layer and the silver halide emulsion layer, said neutralizing layer providing a pH of 11 or less to the silver halide emulsion layer, the improvement wherein the barrier layer includes a polymer comprising randomly repeating units of the formula:

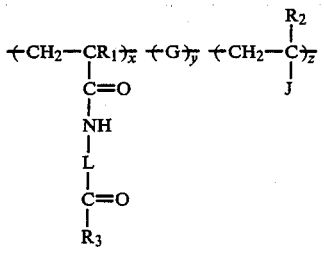

wherein $R_1$ and $R_2$ each independently represents hydrogen or methyl, $R_3$ represents alkyl of from 1 to 4 carbon atoms, L represents an divalent alkyl linking group of from 2 to 8 carbon atoms, J represents the residue of an organic cross-linking compound having at least one other copolymerizable carbon-carbon double bond, G represents recurring units derived from one or more other polymerized ethylenically unsaturated comonomers, x represents 50 to 8 weight percent, y represents 1 to 40 weight percent, and z represents from 10 to 25 weight percent.

5. A photographic element according to claim 4 wherein the polymer comprises randomly recurring units of the formula:

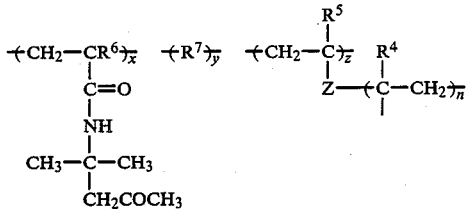

wherein

Z is a linking group, $R^4$, $R^5$, and $R^6$ are individually hydrogen or methyl, $R^7$ represents recurring units in the polymer of one or more other polymerized addition polymerizable comonomers, n is 1 or 2, x represents 50 to 89 weight percent, y represents 1 to 40 weight percent, and z represents from 10 to 25 weight percent.

6. A photographic element according to claim 4 wherein J is selected from the group consisting of ethylenebis(iminocarbonyl), ethylenebis(oxycarbonyl), and phenylene.

* * * * *

UNITED STATES PATENT AND TRADEMARK OFFICE

CERTIFICATE OF CORRECTION

PATENT NO. : 4,865,946

DATED : September 12, 1989

INVENTOR(S) : W. A. Bowman et.al.

It is certified that error appears in the above-identified patent and that said Letters Patent is hereby corrected as shown below:

Column 16, line 66, delete "80" and insert --89--.

Column 18, line 25, delete "8" and insert --89--.

Signed and Sealed this

Thirteenth Day of November, 1990

*Attest:*

HARRY F. MANBECK, JR.

*Attesting Officer*

*Commissioner of Patents and Trademarks*